US006701653B2

(12) United States Patent
Chess et al.

(10) Patent No.: US 6,701,653 B2
(45) Date of Patent: Mar. 9, 2004

(54) POINT OF PURCHASE DISPLAY ASSEMBLY AND METHOD

(75) Inventors: Stanley C. Chess, Goffstown, NH (US); Craig A. Chevalier, Londonderry, NH (US)

(73) Assignee: Moore North America, Inc., Stamford, CT (US)

( * ) Notice: Subject to any disclaimer, the term of this patent is extended or adjusted under 35 U.S.C. 154(b) by 0 days.

(21) Appl. No.: 10/368,613

(22) Filed: Feb. 20, 2003

(65) Prior Publication Data

US 2003/0131512 A1 Jul. 17, 2003

(Under 37 CFR 1.47)

Related U.S. Application Data

(62) Division of application No. 09/985,796, filed on Nov. 6, 2001, now Pat. No. 6,649,238.

(51) Int. Cl.[7] ..... G09F 3/10

(52) U.S. Cl. ..... 40/638; 40/650; 40/661.03; 40/594

(58) Field of Search ..... 40/638, 650, 661.03, 40/594; 283/81

(56) References Cited

U.S. PATENT DOCUMENTS 3,706,150 A * 12/1972 Greenberger ..... 40/661.03
4,167,073 A * 9/1979 Tang ..... 40/661.03
4,222,187 A * 9/1980 Huck ..... 40/594
5,484,168 A 1/1996 Chigot
5,848,698 A * 12/1998 Stompe ..... 40/661.03
5,955,166 A 9/1999 Murphy
5,967,343 A * 10/1999 Dufresne ..... 40/661.03
6,096,397 A 8/2000 Murphy
6,408,553 B1 * 6/2002 Brown et al. ..... 40/661.03

* cited by examiner

*Primary Examiner*—Gary Hoge
(74) *Attorney, Agent, or Firm*—Nixon & Vanderjye PC

(57) ABSTRACT

A point of purchase label construction for being associated with a displayed item for purchase. The label construction includes a label face stock, an opaque liner ply, the first face of the liner ply having an adhesive release coating portion and a release coating free portion. A line of weakness is disposed in the liner ply separating it into a first portion having the release coating for being readily removed to expose adhesive on a portion of the face stock, and a second release coating free portion. That exposed adhesive is pressed into contact with a surface of a point of purchase display so that the point of purchase indicia is readily visible. The second portion of the liner ply may have point of purchase indicia so that it can be bent to define a point of purchase flag.

7 Claims, 3 Drawing Sheets

POINT OF PURCHASE DISPLAY ASSEMBLY AND METHOD

This application is a Divisional of application Ser. No. 09/985,796, filed Nov. 6, 2001, now U.S. Pat. No. 6,649,238 the entire contents of which is hereby incorporated by reference in this application.

BACKGROUND AND SUMMARY OF THE INVENTION

In point of purchase displays in retail establishments, common sales aids are used directly at the points of purchase that are referred to as "shelf talkers". Traditional shelf talkers are face printed pressure sensitive, typically removable, adhesive labels with the adhesive exposed on the back when the liner is removed. This allows it to stick face down, often covering something below it, such as regular price information. While such removable adhesive shelf talkers are advantageous in that they can be readily applied and removed as needed, because they lay flat they may not attract the consumers attention to the targeted product. Other conventional shelf talkers are in the form of a card stock that is placed inside the ribbing of a shelf or placed inside a plastic tab. Because these also lay flat, they may also fail to attract the consumers attention to the targeted product. Yet other shelf talkers are in the form of a card stock that is secured in a clip to project at a 90 degree angle to the shelf. While a projecting card will attract the consumer's attention, the card may inadvertently become dislodged from the clip, particularly when the consumer takes merchandise from the shelf.

In addition to the above noted short-comings, many conventional shelf talkers are cumbersome and time consuming to put up and take down, and in retail establishments where there is a high volume of traffic or constantly changing advertised specials, price reductions, or the like, shelf talkers sometimes need to be put up and taken down daily or weekly. Conventional cut-to-size card stock shelf wrap in particular is very cumbersome and time consuming, gets hard to see, and gets bent or sticks out at eye level due to the multitude of shelving, pallet, and peg configurations that it is forced to fit. Spending time with such tags takes away from time that sales representatives could better be spending interfacing with customers, stocking shelves, or the like. Also, typical shelf talkers lack versatility. That is, they are in general adapted to be applied at the point of purchase in only one way.

According to the present invention, a point of purchase label construction, particularly utilizable in a display assembly, and in a method of associating point of purchase indicia with a point of purchase display, is provided that has significant advantages compared to the prior art techniques. The label construction, or "shelf talker", according to the present invention may be either adhesively applied or may be placed inside a plastic tab so that the label construction can be adapted to the product labeling scheme provided by the retailer. They also allow for several other unique folding capabilities for those facings that do not conform entirely to conventional practice. The label constructions according to the present invention provide a front face which has an attractive appearance and the label construction can either be disposed flat or a portion of the label may be bent to stand out as a flag portion at an angle of up to 90 degrees. The flag portion will not delaminate and, therefore, will continue to display its message to customers until the label is removed and will not be dislodged as can occur with cards inserted in clips. While the label construction is durable and remain intact, they are easily detached from the product display, have great eye appeal and selling appeal, a professional look, and most significantly are easier to use, more versatile, and less costly and time consuming to install than conventional shelf talkers. The label constructions according to the invention also can be used in association with a vertical wall of a display rack.

Thus, according to one aspect of the present invention a point of purchase label construction is provided comprising the following components: a label face stock ply having first and second faces; an opaque liner ply having first and second faces, a first portion of the first face of the liner ply having an adhesive release coating and a second portion of the first face of the liner ply being free from an adhesive release coating; a pressure sensitive adhesive between the adhesive liner ply first face and the label face stock ply second face, holding the plies together; and a line of weakness defined in the liner ply separating the liner ply into a first portion corresponding to the first portion of the first face and a second portion corresponding to the second portion of the first face, thereby allowing ready removal of the first portion from the face stock ply to expose the adhesive on a portion of the face stock ply second face.

In a presently preferred embodiment, the liner ply second portion has point of purchase indicia imaged on the second face thereof. Furthermore, in that embodiment, the face stock ply can be composed of first and second portions corresponding to the first and second portions of the liner ply and the second portion of the face stock ply has point of purchase indicia imaged thereon. Accordingly, in that embodiment, if desired, the second portion of the liner ply and the corresponding of the label face stock ply can be bent with respect to a plane of a remainder of the face stock.

Typically, the first portion of the release liner ply second face has directional indicia imaged thereon, such as the words "remove backing from this side" and/or arrows or other indicia indicating that the first portion should be removed in order to utilize the label in its adhesive configuration. In the alternative, the first portion of the release line ply can be retained in position and the entire label construction slid into a plastic tab.

The face stock ply may be of synthetic material, such as polypropylene, and the adhesive is preferably repositional adhesive, such as CLEANTAC™ adhesive used with repositional products of Moore U.S.A., Inc. of Lake Forest, Ill., or the adhesive used for 3M POST-IT® products. The release liner ply may be bond paper, and the adhesive release coating a conventional silicone coating.

The label construction according to the present invention typically is supplied in an integral combination with a plurality of other label constructions in an 8 ½×11 inch sheet, the label constructions separated from each other in the sheet by lines of weakness, such as conventional microperforations. For example between 8–18 label constructions (typically 10 or 12) are provided in a sheet. The sheet may also have removable marginal portions containing instructional indicia on the face stock ply first face, explaining how to use the label constructions. Typically, the label constructions have a quadrate configuration with width and length dimensions of roughly between 1.25–1.75 inches×2.75–5.00 inches, respectively.

According to another aspect of the present invention a display assembly is provided comprising a point of purchase label construction, including: a label face ply having first and second faces; an opaque liner ply part having first and second faces, the first face of the liner ply part being free from an adhesive release coating, and the second face of the liner ply part having a first point of purchase indicia imaged thereon, a pressure sensitive adhesive on the label face stock ply second face, and the first face of the face ply having second point of purchase indicia imaged thereon; the face ply being larger than the liner ply part so that a portion of the adhesive is exposed on the face stock ply second face; a point of purchase display construction having a surface, and associated with a displayed item for purchase; and the exposed adhesive in contact with the surface of the point of purchase display so that at least the second point of purchase indicia is readily visible to one viewing an item displayed by the point of purchase display.

The point of purchase display construction may comprise a shelf, and the surface may comprise a front face of a vertical portion of the shelf. The exposed adhesive may be in contact with the front face of the shelf vertical portion so that the label construction point of purchase indicia is viewable at the same time as the item price information indicia. Preferably the adhesive is repositional so that the label construction may be readily removed from contact with the shelf surface and positioned in another location. The liner ply part may have a quadrate construction with width and length dimensions of about 1½ inches by 1½ inches and the exposed adhesive area of the face ply also has a quadrate construction with width and length dimensions of about 1¼ by 3½ inches.

In this embodiment, the release liner ply and the associated portion of the face label stock ply are bent so as to be oriented at an angle of greater than 90 degrees with respect to the remainder of the first label stock ply so that the point of purchase indicia can be viewed by customers approaching the label construction lengthwise of the shelf from either direction.

Alternatively the point of purchase construction may comprise a peg having a price tag, with the surface comprising the price tag. As yet another alternative the point of purchase display construction may comprise a rack, and the surface a substantially vertical wall of the rack.

According to yet another aspect of the present invention, a method of associating point of purchase indicia with a point of purchase display construction having a surface, and associated with a displayed item for purchase, is provided. The method utilizes a point of purchase label construction such as described above. The method comprises the steps of: securing the label construction with respect to the display construction; and bending the portion of the label construction corresponding to the second portion of the liner ply so that it is disposed at an angle of greater than zero degrees with respect to a remainder of the label construction so that the point of purchase indicia of each the ply is visible.

Where the point of purchase display construction comprises a shelf and the surface is a front face of a vertical portion of the shelf, the step of securing can comprise separating the release liner ply first portion at the line of weakness to expose the adhesive on a portion of the face stock ply second face, and pressing the exposed adhesive into contact with the surface of the point of purchase display construction so that the point of purchase indicia on the face stock first face is readily visible at the same time that the display item is viewed.

It is the primary object of the present invention to provide an advantageous point of purchase label construction, that may be used in an advantageous display assembly and a method of associating point of purchase indicia with a display construction. This and other objects of the invention will become clear from an inspection of the detailed description of the invention, and from the appended claims.

DETAILED DESCRIPTION OF THE INVENTION

Figure 2:
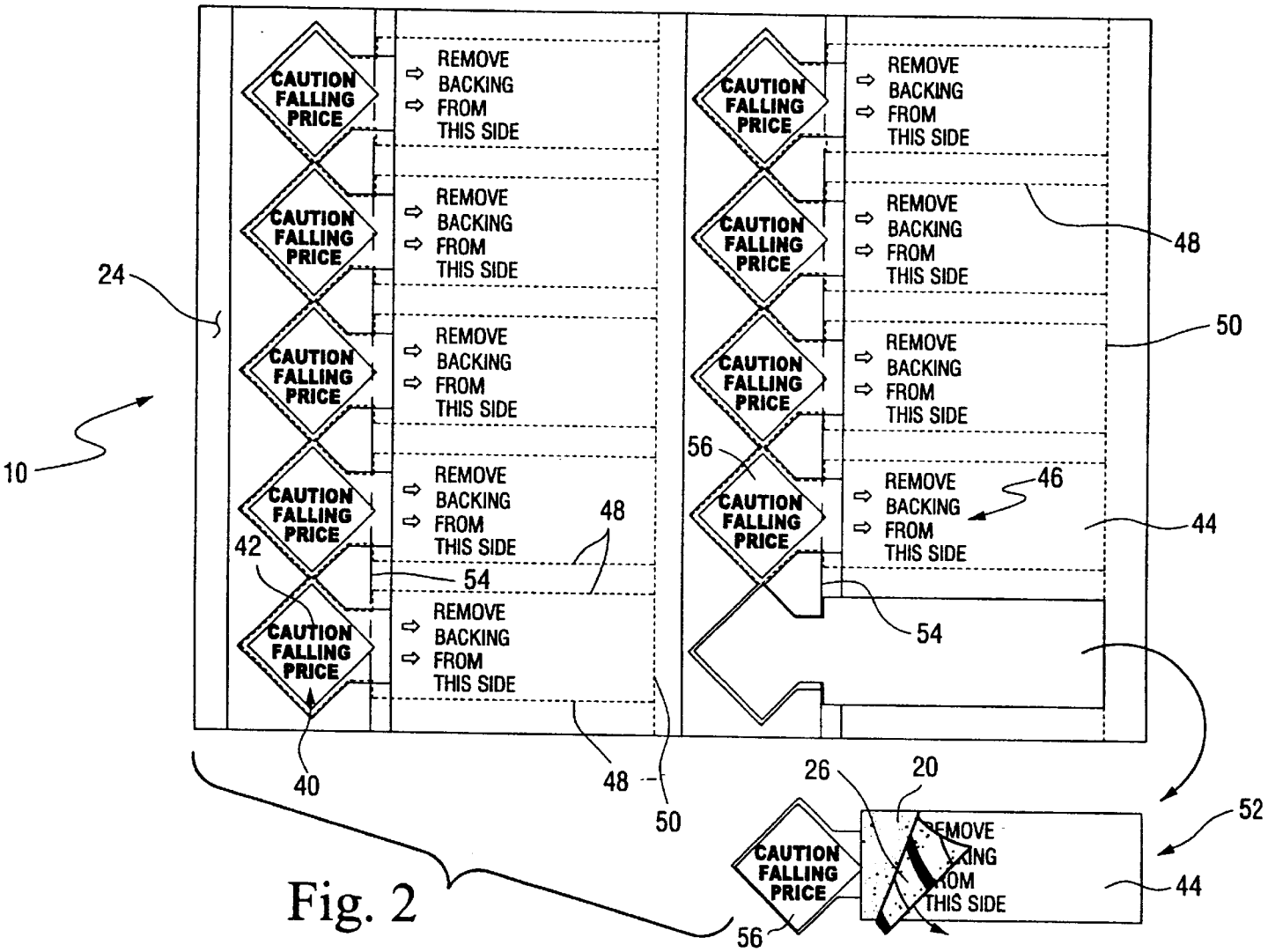
FIG. 2 is a bottom plan view of the sheet of FIG. 1, with one of the label constructions being shown detached therefrom.

A sheet of label constructions is illustrated schematically at 10 in FIG. 2. It includes a label face stock ply 12, having a first face 14 and a second face 16. The face stock ply 12 can range from 18 lb Bond to 125 tag paper base to synthetic or latex impregnated. The label is further comprised of an opaque release liner stock ply 18 that can range from as thin as 25 lb to 90 lb paper base or synthetic. In the exemplary, illustrated embodiment, the form was paper and latex based. Disposed on the second face 16, either from transfer from the opaque release liner stock ply 18, or applied directly thereto, is a pressure sensitive adhesive shown schematically at 20. Preferably the adhesive is pattern coated to the second face 16 of the face stock ply 12. An advantage of pattern coating is that any adhesive pattern can be made, such as providing for lift edges for ease of label removal, no adhesive on the edges of the plies to eliminate printer contamination, and the like. The pressure sensitive adhesive 20 may be permanent or removable adhesive of conventional type, but preferably is a conventional repositional adhesive, such as CLEANTAC™ adhesive used with CLEANTAC® labels and other products available from Moore U.S.A., Inc. of Lake Forest, Ill., or the type of repositional adhesive used in POST-IT® products available from 3-M of Minneapolis, Minn.

Figure 1:
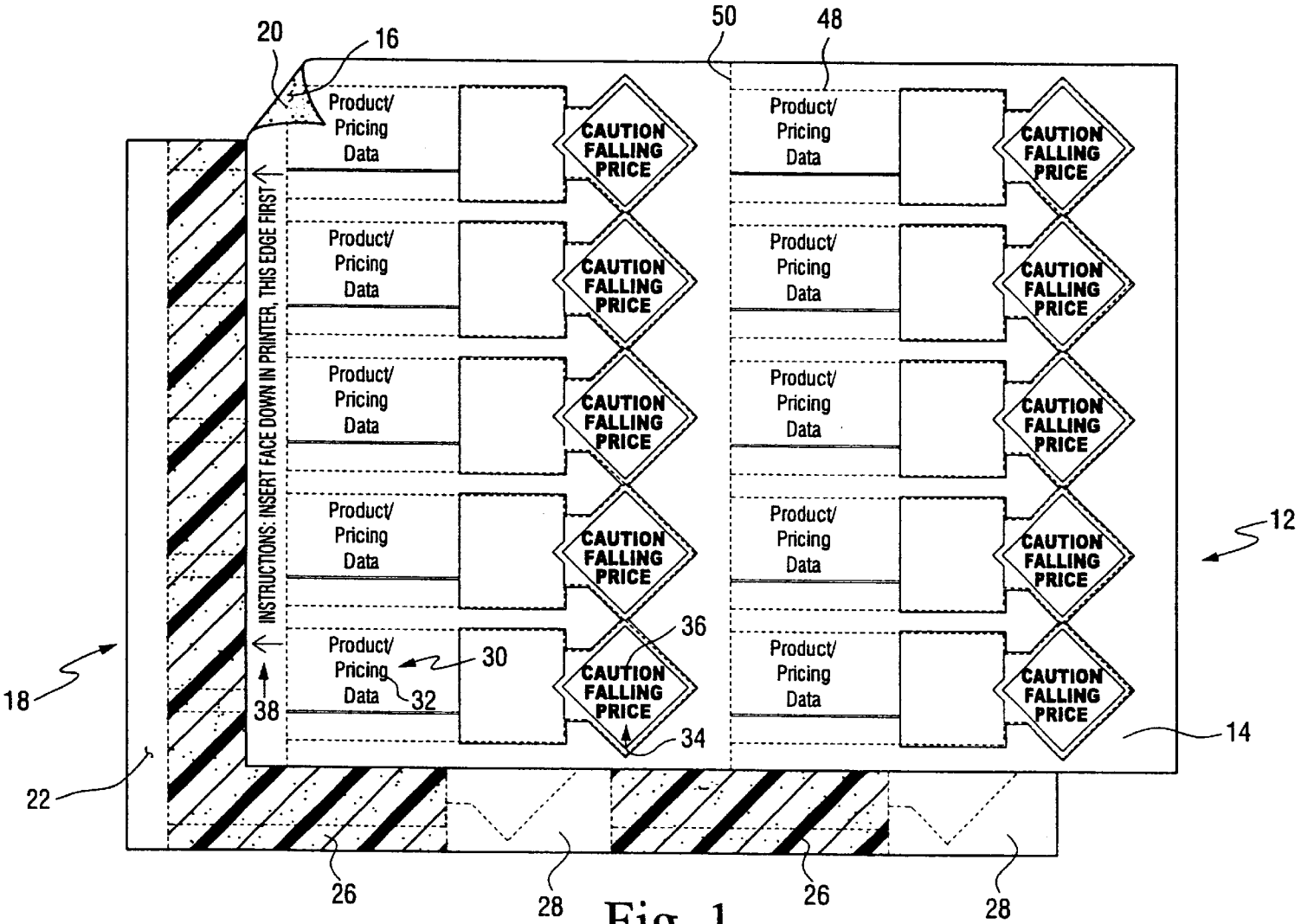
FIG. 1 is a top perspective exploded view of a sheet of point of purchase label constructions according to the present invention.

The liner ply 18 has a first face 22 and a second face 24, the first face 22 has an adhesive release coating—shown schematically at 26 in FIG. 1. Any conventional adhesive release coating which will readily release from the adhesive 20 may be provided, such as a conventional silicone coating. As illustrated, the silicone or other adhesive release coating 26 is discontinuously or patterned applied to the first face 22 of the liner ply 18. As described in greater detail below, an area of the label construction is adapted to be optionally bent at an angle of about 90 degrees to define a flag 70 for attracting the customer's attention. The adhesive release coating 26 is patterned, stripped or the like to provide select portions 28 of the liner ply first face that are free from any release coating so as to be more securely bonded on completion of the construction. Thus, the reason for the release coating free portion 28 is to reduce or eliminate the possibility of having the liner ply 18 delaminate and fall off of the portion 70 of the label construction 52 that is disposed at an angle to define a flag.

In the illustrated embodiment, the first face 14 of the face stock ply 12 has an area 30 for price and/or item data or indicia 32 and an area 34 for point of purchase indicia 36 to be imaged thereon. For example, this point of purchase indicia 36 could be "as advertised", "new item", "new price", "clearance", "less than $2", or a wide variety of other types of point of purchase messages aside from pure price or item information. In an exemplary embodiment, indicia 36 is preprinted on the label sheet 10, according to an order placed with the label supplier, whereas the product related indicia 32 is printed by the retailer. The indicia 32, 36 may be imaged on the face 14 in any conventional manner using any conventional impact, electrostatic, or like imaging technique. The face 14 may be made glossy, as by providing a glossy coating like varnish. The face stock ply first face 14, surrounding the label constructions is devoid a point of purchase indicia since it is only the indicia 32,36 that will be viewed by a potential customer in a normal circumstance and environment. However, the face 14 surrounding the label construction may be provided with instructional, reorder, or like indicia, such as instructions as to how to print the form, as shown at 38.

The liner ply 18 second face 24 also includes an area 40 for point of purchase indicia 42. Area 40 corresponds to the release coating free portion 28 of the liner ply first face 22. Indicia 42 may be imaged on face 24 in any conventional manner using any conventional impact, electrostatic, or like imaging technique. As mentioned above, this is the portion 70 of the label construction 52 that is adapted to be selectively bent at an angle to the remainder of the label construction so that it will be more visible to the customer. The first portion 44 of the liner ply which corresponds to the release coated portion 26 may be free of pre-printed indicia or may include indicia 46 such as instructions on removing the label backing.

The plies 12, 18 are held together by the adhesive 20. Further, the plies 12, 18 include lines of weakness 48, 50 therein for defining individual label constructions 52. More particularly, each sheet 10 preferably has dimensions of about 8½×11 inches (although it may be of other conventional readily usable sizes, such as legal size or A4) with individual label constructions 52 separated by the lines of weakness 48,50. For example, see FIG. 2 which shows the plies held together by the adhesive, and shows major lines of weakness 48 dividing the sheet into individual label constructions 52. Also lines of weakness 50 may be provided for dividing the label constructions from marginal portions of the sheet which have instructional indicia 38 therein and/or to divide the sheet into strips of labels. A single line of weakness 54 is further provided in each label construction. The single line of weakness 54 associated with each label construction 52 is provided in the release liner stock ply 18 and separates the liner ply into a first portion 44 (see label construction in FIG. 2), and a second portion 56, smaller than the first portion, corresponding to the area 40 having point of purchase indicia 42 imaged thereon. The line of weakness 54 allows ready removal of portion 44, which has release coat 26 thereon, to expose the adhesive 20 on the face stock ply second face underlying portion 44. FIG. 2 illustrates the portion 44 being removed as indicated by the arrow. The portion 44 may have indicia 46 imaged thereon—such as the words "remove backing from this side" as illustrated in FIG. 2.

The lines of weakness 48, 50, 54 may be any conventional line of weakness such as perforations, die cuts or the like. Lines of weakness 48, 50 are preferably conventional microperforations that either extend through both plies or are offset from one another, while the lines of weakness 54 are provided to extend only through the liner ply and are preferably die cuts. As a further alternative, lines of weakness 48 may be defined only through the face ply in the area of release coating 26 and clear through in the area 28 of no release coating so that the labels can be peeled off the liner ply by detaching the part of the label corresponding to second portion 56 from the rest of the face and liner plies and then peeling the rest of the label off the liner ply.

While the label constructions may have a wide variety of sizes, typically—as illustrated in FIG. 2—between 8–18 label constructions are provided in an 8½×11 inch sheet. In this way each label construction has a quadrate configuration with width and length dimensions of roughly 1.25–1.75 inches×2.75–5.00 inches, respectively.

Figure 3:
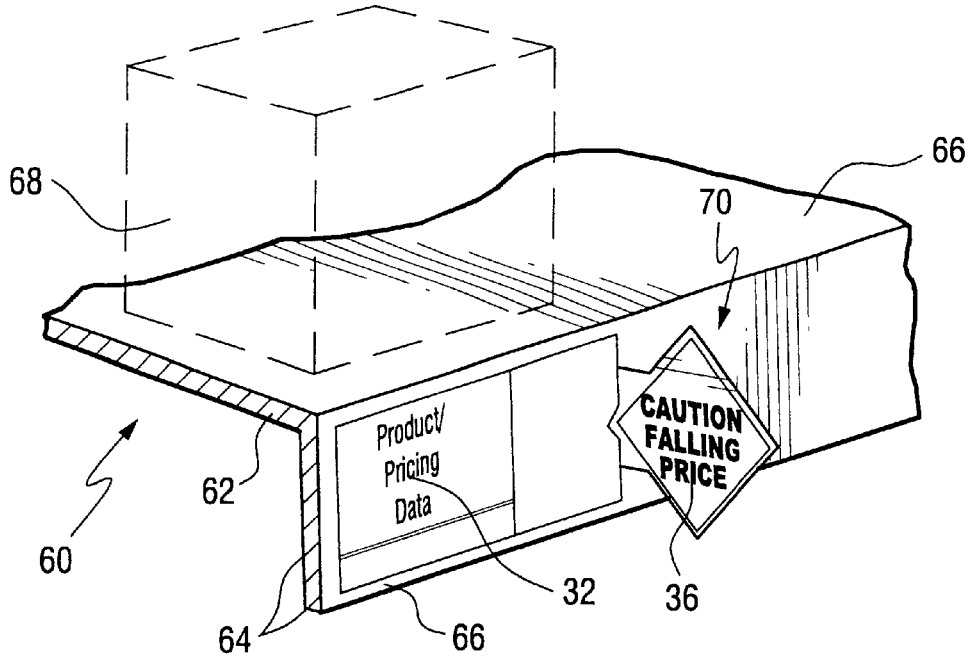
FIG. 3 is a top perspective schematic view of the detached label construction of FIG. 2 shown in association with a shelf having a display item thereon.
Figure 4:
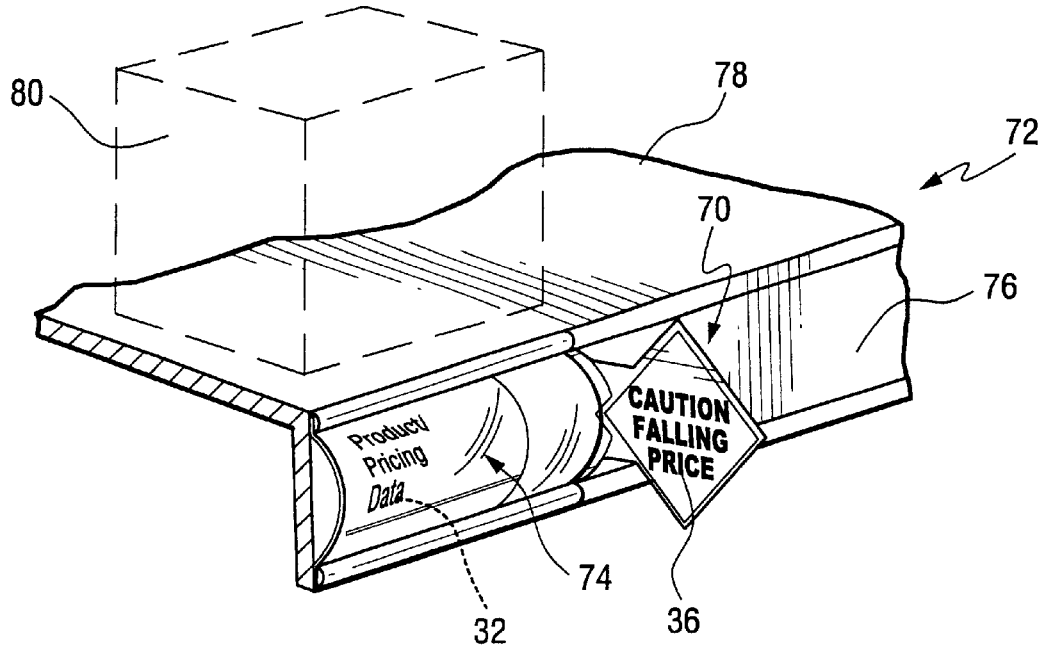
FIG. 4 is a front schematic view of the label construction of FIG. 2 shown associated with a plastic tab price card holder.

FIG. 4 illustrates one embodiment of a display assembly, shown generally by reference numeral 60, according to the present invention in which the label construction 52 is seen in actual use with a point of purchase display construction, in this case a shelf 62 having a vertical portion 64 (e.g. downwardly extending) having a front face 66. The front face typically has price, item, and like information displayed thereon. The display construction is associated with a display item 68, schematically shown in dotted lines in FIG. 3, available for purchase. The item can be any item that the retail store sells in any type of packaging.

The label construction is used in the display assembly so that the exposed adhesive 20 which was covered by the removed release liner portion 44 (see FIG. 2) is pressed into contact with the front face 66 of the shelf vertical portion 64. This means that the label construction point of purchase indicia 36 is visible at the same time as the item price information indicia 32, as seen in FIG. 3. Furthermore, as illustrated, a portion 70 of the label construction 52 corresponding to the second portion 56 of the liner ply 18 and its associated portion of the face stock ply has been bent at an angle, of about 90 degrees in the illustrated embodiment, to define a flag to attract the customer's attention. As will be appreciated, the flag 70 provides an effective point of purchase message, because the point of purchase indicia 36 on the face stock as well as the point of purchase indicia 42 on the second portion 56 of the liner ply 18 are highly visible to the consumer approaching the product from either direction along the associated store aisle. Thus, the label construction according to the invention delivers an effective point of purchase message with significant eye appeal and selling appeal, and a professional look, and is easy and inexpensive to apply and remove.

In an exemplary embodiment, a bright neon color can be printed to selected portions of the face label stock and liner ply to further attract the customer's attention. In the illustrated embodiment, the point of purchase indicia "CAUTION FAILING PRICE" is denoted. Consistent with the theme of a warning sign, the flag 70 is diamond-shaped and may be, for example, a neon yellow or orange with black perimeter and print, consistent with conventional construction signs and consistent with the customer attention attracting intent of the flag. It is to be understood, however, that the shape of the flag is in general not critical to the formation of the flag and a flag that is virtually any geometric shape may be used. For example, a circle may be applied, a hexagon such as a stop sign shape, a triangle with the apex of the triangle directed towards the remainder of the label as an arrow, and other such flag shapes may be used to advantage in attracting the customer's attention. Thus, the invention is not to be limited to the particular geometric shape illustrated and/or the point of purchase indicia of the illustrated embodiment.

Thus in the utilization of the label construction in a display assembly, first a label construction 52 is detached at the lines of weakness 48, 50 from a sheet 10 of labels, the release liner portion 44 is removed to expose the adhesive underlying it, and that adhesive section is then pressed into contact with the front face 66 of the shelf vertical portion.

The flag portion can be retained in its generally planar orientation or, more preferably, to attract the customer's attention, the flag portion 70 is displaced to be disposed at an angle of, for example, 90 degrees to maximize visibility to the customer as illustrated in FIG. 3.

FIG. 4 is a schematic illustration of another exemplary display assembly 72 according to this invention. In this case, the display assembly comprises a conventional plastic tab 74 which typically receives card stock to display product and pricing information, mounted to the front face 76 of a shelf 78. The label construction of the invention may be advantageously used with such a plastic tab display because the release liner ply first portion 44 need only be removed where adhesive attachment is desired. Thus, rather than removing the first portion of the liner ply to expose the adhesive, the label construction 52 of the invention is simply inserted behind the plastic tab 74 to display the indicia 32 for example data regarding pricing of the product 80. Again, the flag may be retained in contiguous planar relation to the remainder of the label construction or, more advantageously, to attract the customer's attention and as shown in FIG. 4, the flag portion 70 is displaced to project from the front face 76 of the product shelf 78 so that the point of purchase indicia 36, 42 is maximally visible.

As mentioned above, though not illustrated in detail, the adhesive 20 pattern can be determined to define lift edges for facilitating label removal from the display shelf and/or to facilitate processing of the sheet of labels shown in FIG. 2. In that regard, depending upon the shape of the point of purchase indicia flag, it may-be possible for label removal to grip the flag portion 70 and pull the label from the shelf or other vertical support surface. In the event the joint of the flag portion to the remainder of the label is relatively narrow, however, to avoid label fracture, the provision of a lift corner at a opposite end of the label would facilitate label removal for re-placement without label damage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A display assembly, comprising:

a point of purchase label construction, including: a label face ply having first and second faces; an opaque liner ply part having first and second faces, the first face of the liner ply part being free from an adhesive release coating, and the second face of the liner ply part having a first point of purchase indicia imaged thereon, a pressure sensitive adhesive on the label face ply second face, and the first face of the face ply having second point of purchase indicia imaged thereon; the face ply being larger than the liner ply part so that a portion of the adhesive is exposed on the face ply second face;

a point of purchase display construction having a surface, and associated with a displayed item for purchase; and said exposed adhesive in contact with said surface of said point of purchase display so that at least said second point of purchase indicia is readily visible to one viewing an item displayed by said point of purchase display.

2. An assembly as recited in claim 1 wherein said label construction is bent so that both said first and second point of purchase indicia is visible.

3. An assembly as recited in claim 1 wherein said adhesive is repositional so that said label construction may be readily removed from contact with said shelf surface and positioned in another location.

4. An assembly as recited in claim 1 wherein said liner ply part has a quadrate construction with width and length dimensions of about 1½ inches by 1½ inches, respectively, and said exposed adhesive area of said face ply also has a quadrate construction with width and length dimensions of about 1¼ by 3½ inches.

5. A method of associating point of purchase indicia with a point of purchase display construction having a surface, and associated with a displayed item for purchase; comprising:

(a) providing a point of purchase label construction including:

a label face stock ply having first and second faces;

an opaque liner ply having first and second faces, a first portion of said first face of said liner ply having an adhesive release coating and a second portion of said first face of said liner ply being free from an adhesive release coating;

a pressure sensitive adhesive between said liner ply first face and said label face stock ply second face, holding said plies together; and a line of weakness defined in said liner ply separating said liner ply into a first portion corresponding to said first portion of said first face and a second portion corresponding to said second portion of said first face, thereby allowing ready removal of said first portion from said face stock ply to expose said adhesive on a portion of said face stock ply second face;

the second face of the liner ply having a point of purchase indicia imaged on the second portion thereof and the first face of the face stock ply having a point of purchase indicia imaged thereon;

(b) securing said label construction with respect to said display construction; and (c) bending the portion of said label construction corresponding to said second portion of said liner ply so that it is disposed at an angle of greater than zero degrees with respect to a remainder of said label construction so that said point of purchase indicia of each said ply is visible.

6. A method as recited in claim 5 wherein said step of securing comprises separating the liner ply at the line of weakness to expose the adhesive on a portion of the face stock ply second face; and pressing the exposed adhesive into contact with the surface of the point of purchase display construction so that the point of purchase indicia on the face stock ply second face is readily visible at the same time that the display item is viewed.

7. A method as recited in claim 5 wherein said step of securing comprises inserting a portion of said label construction in a plastic price card holder.

* * * * *